US005445315A

United States Patent [19]

Shelby

[11] Patent Number: 5,445,315

[45] Date of Patent: Aug. 29, 1995

[54] INSULATED BEVERAGE RECEPTACLE HOLDER

[75] Inventor: Charles B. Shelby, 7228 Craig St., Fort Worth, Tex. 76112

[73] Assignees: John R. Sexton, Trophy Club; Michael L. Morton, Dallas; Charles B. Shelby, Fort Worth, all of Tex.

[21] Appl. No.: 222,550

[22] Filed: Apr. 1, 1994

[51] Int. Cl.[6] ..... B65D 5/36

[52] U.S. Cl. ..... 229/117.06; 220/903; 220/462

[58] Field of Search ..... 229/109, 110, 117.05, 229/117.06; 206/523; 220/903, 902, 462

[56] References Cited

U.S. PATENT DOCUMENTS

| | | | |
|---|---|---|---|
| 1,971,863 | 8/1934 | Lupton | 229/117.06 |
| 2,979,246 | 4/1961 | Lieberskind | 206/523 |
| 3,421,679 | 1/1969 | Goldman | 206/523 |
| 3,425,616 | 2/1969 | Adams, Jr. | 229/117.06 X |
| 3,473,682 | 10/1969 | Studen . | |
| 4,146,169 | 3/1979 | Meyers et al. | 229/110 |
| 4,194,627 | 3/1980 | Christensen . | |
| 4,199,098 | 4/1980 | Lopez | 229/110 X |
| 4,540,611 | 9/1985 | Henderson . | |
| 4,648,525 | 3/1987 | Henderson . | |
| 4,699,282 | 10/1987 | Farrar | 206/523 X |
| 4,736,885 | 4/1988 | Negus, Sr. | 229/110 |
| 4,953,705 | 9/1990 | Evamy | 206/523 X |
| 5,102,036 | 4/1992 | Orr et al. | 220/903 X |

*Primary Examiner*—Allan N. Shoap
*Assistant Examiner*—Christopher McDonald
*Attorney, Agent, or Firm*—Grady K. Bergen

[57] ABSTRACT

A collapsible beverage holder for a beverage container is formed from a substantially rigid paperboard sheet having a rectangular body portion having opposite lateral side edges. The rectangular body portion is provided with several longitudinal creases which divide the rectangular body portion into panels so that the panels can be folded relative to each other. By joining the lateral ends of the body portion together, a sleeve can be formed from the rectangular body portion. A bottom portion is provided with the beverage holder by providing an extended portion of the paperboard sheet which extends from a lower end of the rectangular body portion. The bottom portion is provided with a transverse crease dividing the bottom portion into rigid sections which are foldable relative to each other along the transverse crease. The bottom portion has a free end which is joined to a lower edge of the sleeve. The sleeve is foldable between a first, flat configuration and a second, expanded configuration which creates an upper and lower opening of the sleeve. The beverage container is inserted into the sleeve through the upper opening. The bottom portion extends across the lower opening of the sleeve when the sleeve is in the second configuration to prevent the beverage container from sliding through the lower opening.

11 Claims, 2 Drawing Sheets

INSULATED BEVERAGE RECEPTACLE HOLDER

BACKGROUND OF THE INVENTION

1. Field of the Invention

This invention relates to a collapsible beverage holder or jacket which is formed from paperboard and a layer of insulation for holding a beverage container.

2. Description of the Prior Art

Beverage holders are commonly formed as a cylindrical sleeve constructed from a layer of insulative foam material into which a beverage container, such as an aluminum soda can, can be inserted. Beverage holders of this type typically will have a bottom to prevent the beverage container from slipping from the cylindrical sleeve. The beverage holders which are constructed solely of insulative foam must be relatively thick in order for the beverage holder to be durable and sufficiently rigid for repeated use. Because most beverage holders assume a permanent cylindrical shape when not in use, the beverage holders utilize a large amount of storage space. This can be a problem especially when a large quantity of beverage holders must be stored or transported and there is a limited amount of space.

The outer surface of these beverage holders will often be printed with words or images. The insulative foam material which the beverage holder is constructed from can be difficult to print on and may require the use of special coatings or processes to create the image or message. This can significantly increase the cost of manufacturing the beverage holder. Often the beverage holders are printed with advertisements or logos and used as an advertising medium. Such beverage holders are often given away as promotional gifts and therefore it is preferable to keep the cost of manufacturing the beverage holders as low as possible.

It would be advantageous to have a beverage holder that is collapsible so that it occupies very little space when not in use, is easily printed on and fairly inexpensive to manufacture.

SUMMARY OF THE INVENTION

A beverage holder is provided which is collapsible so that it occupies very little space when not in use, is easily printed on and fairly inexpensive to manufacture. The collapsible beverage holder is constructed from a body portion formed from a single paperboard sheet. The body portion has an upper end and a lower end and opposite lateral side edges which are joined together to form a sleeve having an inner surface. The body portion has at least two longitudinally extending creases which extend between the upper and lower ends and are laterally spaced apart along the body portion dividing the body portion into panels. The panels are foldable about the longitudinally extending creases so that the sleeve is foldable between a substantially flat configuration and an expanded configuration to form an upper opening for receiving the beverage container.

A paperboard bottom portion is also provided with the beverage holder. The bottom portion is joined along an opposite side edge to the lower end of the body portion so that the paperboard bottom extends across a lower opening of the sleeve when the sleeve is in the expanded configuration. The bottom portion has a transverse crease which divides the bottom portion into sections. The sections are foldable about the transverse crease so that the sections fold together in a substantially flat configuration when the sleeve is in the flat configuration. A layer of insulation material is bonded to the inner surface of the sleeve for insulating the beverage container.

DETAILED DESCRIPTION OF THE INVENTION

Figure 1:
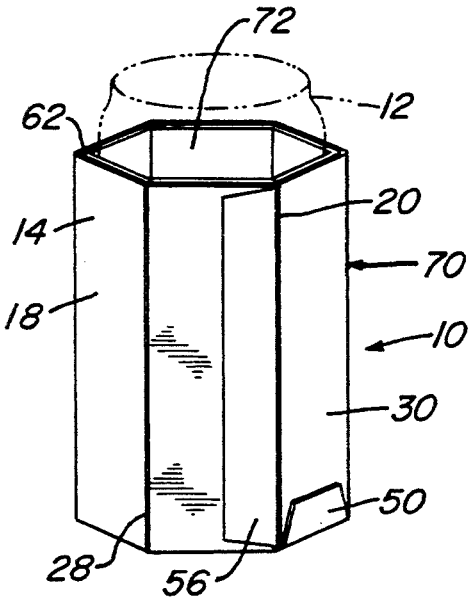
FIG. 1 is a perspective view of a collapsible beverage holder constructed in accordance with the invention.
Figure 2:
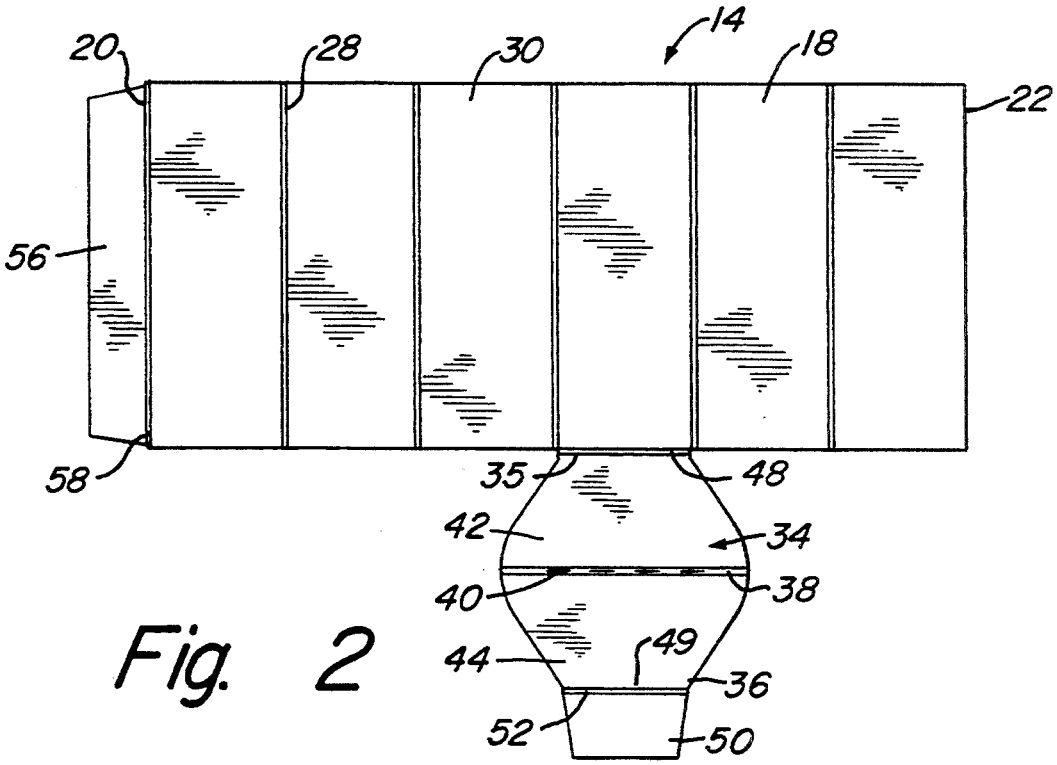
FIG. 2 is a side view of a paperboard sheet used in the construction of the collapsible beverage holder of the invention.

Referring to the figures, FIG. 1 shows a collapsible beverage holder 10 of the invention for receiving a beverage container 12, such as a soda can, represented by the dotted lines. The beverage holder 10 is constructed from a sheet of paperboard 14, as shown in FIG. 2. The paperboard sheet 14 has a rectangular body portion 18 having an upper end, a lower end and opposite lateral side edges 20, 22. Extending from the upper end of the rectangular body portion 18 are longitudinally extending creases 28 which extend from the upper end to the lower end of the body portion 18. The longitudinally extending creases are spaced laterally apart at equal distances dividing the rectangular body portion 18 into six panels 30 having equal widths. The paperboard sheet 14 is made of substantially rigid paperboard material having a thickness ranging between 0.010 inches and 0.026 inches. The paperboard sheet 14 may be a solid, flat paperboard or may be of the corrugated-type paperboard. The longitudinally extending creases 28 are formed by scoring the sheet of paperboard 14.

Extending from the body portion 18 is a bottom portion 34 which is joined along a side edge 35 to the body portion 18. The side edge 35 is substantially the width of one of the panels 30. The bottom portion 34 has a free end 36 opposite the side edge 35. A transverse crease 38 extends across the width of the bottom portion 34. The transverse crease 38 may also be provided with perforations 40. The transverse crease 38 divides the bottom portion 34 in half, forming rigid sections 42, 44. The sections 42, 44 are foldable relative to each other about the transverse crease 38. The perforations 40 allow the sections 42, 44 to be more easily folded. As seen in FIG. 2, the bottom portion 34 gradually increases in width from the side edge 35 to the transverse crease 38 and gradually decreases in width from the transverse crease 38 to the free end 36, so that the bottom portion 34 has a somewhat circular shape. A crease 48 is formed along the side edge 35 where the bottom portion 34 is joined to the body portion 18. The crease 48 allows the bottom portion 34 to be foldable along the side edge 35.

Extending from the free end 36 of the bottom portion 34 along a side edge 49 and formed from the paperboard sheet is a bottom tab 50. A crease 52 is formed along the side edge 49 of the bottom portion 34 where the bottom tab 50 joins the bottom portion 34. This allows the bottom tab 50 to be folded relative to the bottom section 44 of the bottom portion 34. The transverse crease 38 and the creases 48, 52 along side edges 35, 49, respectively, are parallel to each other.

Also formed from the paperboard sheet 14 is a projection 56 which extends from the lateral side edge 20 of the body portion 18. A crease 58 which extends along the lateral side edge 20 allows the projection 56 to be folded relative to the panel 30 adjacent to the lateral side edge 20.

Figure 3:
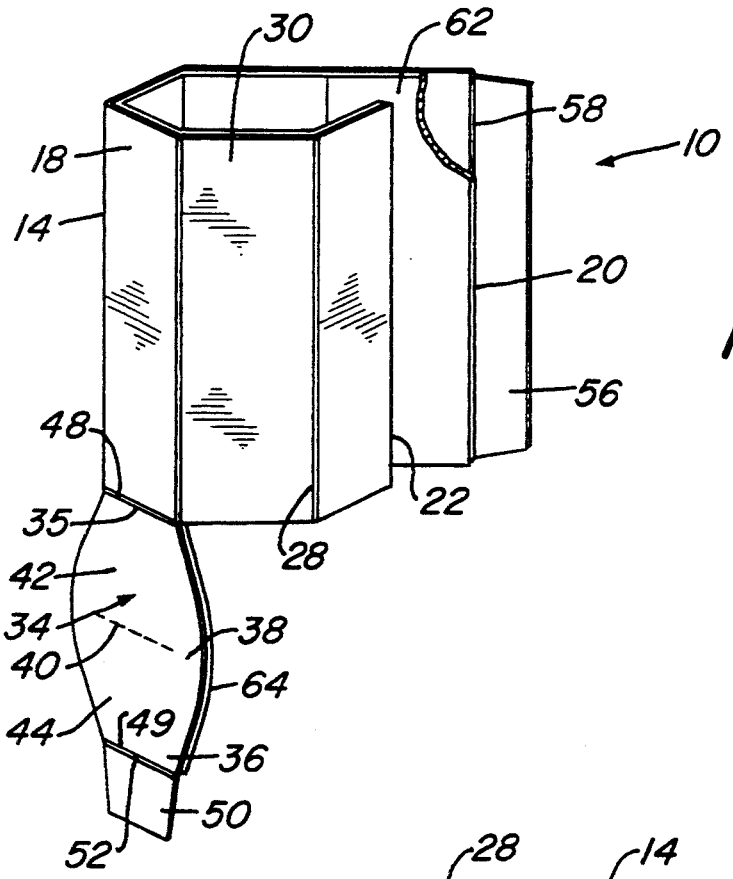
FIG. 3 is a perspective view of the collapsible beverage holder which is partially assembled and constructed in accordance with the invention.
Figure 4:
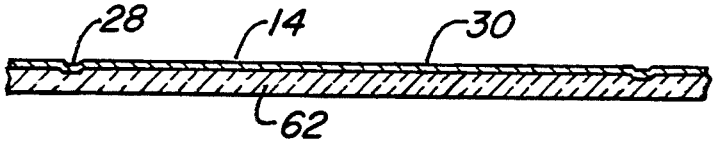
FIG. 4 is a cross-sectional view of the paperboard sheet and insulation material of the collapsible beverage holder constructed in accordance with the invention.

Referring to FIGS. 3 and 4, a layer of insulation material 62 is bonded to the body portion 18 of the paperboard sheet 14. The insulation material 62 is a polymeric foam material, such as polyethylene foam, having a thickness ranging from between 1/16 to ⅛ of an inch. A layer of insulation material 64 is also bonded to an upper surface of the bottom portion 34.

Figure 5:
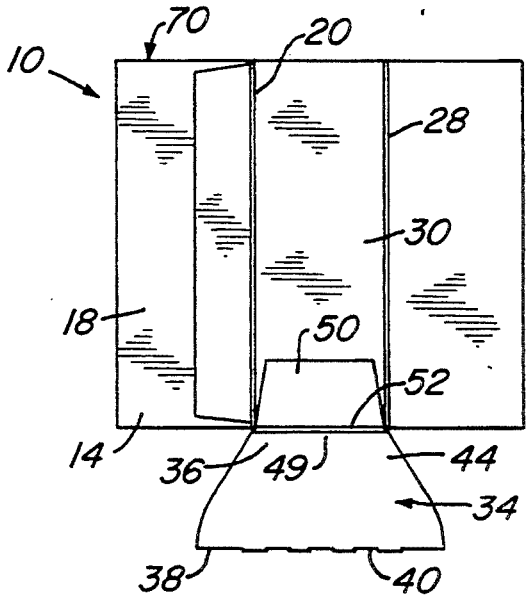
FIG. 5 is a side view of the collapsible beverage holder shown in a substantially flat configuration and constructed in accordance with the invention.
Figure 6:
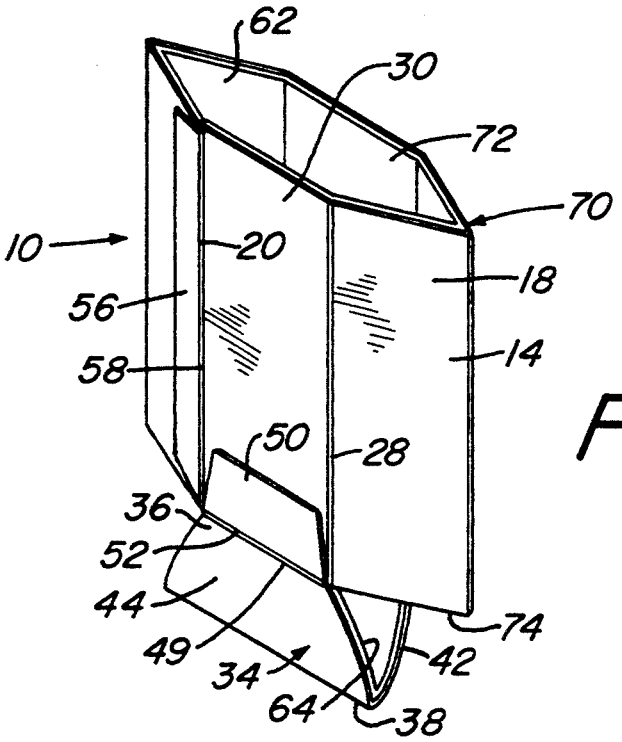
FIG. 6 is a perspective view of the collapsible beverage shown in a partially expanded configuration and constructed in accordance with the invention.

By joining the lateral side edges 20, 22 together, the body portion 18 forms a sleeve 70, which is shown in FIGS. 5 and 6. The sleeve 70 has an upper opening 72 and a lower opening 74. The bottom portion 34 extends across the lower opening 74 of the sleeve 70 with the free end 36 of the bottom portion 34 being attached to the lower edge of the sleeve 70 along the side edge 49 so that the bottom portion 34 is joined to opposite sides of the sleeve 70 along the side edges 35 and 49.

The method of forming the collapsible beverage holder 10 is as follows. The single, continuous paperboard sheet 14 is die cut from rigid paperboard stock substantially in the shape as shown in FIG. 2 with the bottom portion 34 projecting from the lower end of the rectangular body portion 18 and including the bottom tab 50 and the projection 56. Preferably, words or images are printed on the paperboard stock prior to cutting the paperboard sheet 14.

The longitudinally extending creases are then formed in the body portion 18, as well as the transverse crease 38 of the bottom portion 34, the creases 48, 52 along the side edges 35, 49, respectively, of the bottom portion 34, and the crease 58 along the lateral side edge 20. This is accomplished by scoring the paperboard sheet using conventional methods. The perforations 40 may be punched or otherwise formed in the bottom portion 34 along the crease 38.

The inner surface of the body portion 18 is then coated with adhesive and the layer of insulation material 62 is bonded to the inner surface of the body portion 18. The layer of insulation material 62 is substantially rectangular in shape having substantially the same height and width as the rectangular body portion 18. Similarly, the upper surface of the bottom portion 34 is also coated with adhesive and the layer of insulation material 64 is bonded to the upper surface of the bottom portion 34. It should be noted that the bottom tab 50 and projection 56 have no insulation material bonded to them.

After the insulating layers 62, 64 are bonded to the body portion 18 and bottom portion 34, respectively, the lateral side edges 20, 22 are joined together by overlapping the projection 56 with the lateral side edge 22 and gluing the inner surface of the projection 56 along the outer surface of the body portion 18 adjacent to the lateral side edge 22 so that the lateral side edges 20, 22 are permanently joined together. When the lateral side edges 20, 22 are joined together, the body portion 18 forms the sleeve 70, which is shown in FIGS. 5 and 6.

The free end 36 of the bottom portion 34 is joined to a lower edge of the sleeve 70 along the side edge 49. This is accomplished by gluing or otherwise attaching the bottom tab 50 along the exterior of the body portion 18 so that the bottom tab 50 overlaps the lower end or edge of the sleeve 70.

With the lateral ends 20, 22 joined together and the free end 36 of the bottom portion 34 joined to the lower edge of the sleeve 70, the beverage holder 10 can be folded from a first, flat configuration to an second, expanded configuration. As shown in FIG. 5, the beverage holder 10 is folded in the flat configuration along the creases 28 of the body portion 18 so that the panels 30 of the sleeve 70 are in a single plane. The bottom sections 42, 44 are also folded together along the transverse crease 38 so that the bottom sections 42 lie in the same plane as the panels 30. The crease 58 along the lateral side edge 20 allows the sleeve 70 to be folded along the lateral side edges 20, 22. Likewise, the creases 48, 52 along the side edges 35, 49 of the bottom portion 34 allow the bottom portion 34 to be folded relative to the sleeve 70.

When the beverage holder 10 is folded from the first, flat configuration (FIG. 5) to the second, expanded configuration (FIG. 1), the panels 30 fold apart so that the sleeve 70 is in the substantially polyhedron shape of FIG. 1, and the bottom sections 42, 44 are folded apart, as shown in FIG. 6, so that the bottom sections 42, 44 form a flat bottom extending across the lower opening 74 of the polyhedron shaped sleeve 70 of FIG. 1. When the beverage holder 10 is folded to the expanded configuration of FIG. 1, the can or beverage container 12 is inserted through the upper opening 72 of the sleeve 70. The bottom portion 34 prevents the container 12 from slipping through the lower opening 74 of the sleeve 70.

The beverage holder of the invention has several advantages over the prior art beverage holders. The paperboard sheet material provides an excellent printing surface for printed messages, advertisements or other images without using specialized inks, coatings or processes. Because the beverage holder folds to a substantially flat configuration, the beverage holder requires very little space for storage or shipping. The creases formed in the paperboard sheet allow the beverage holder to be easily folded while still maintaining a substantial rigid configuration. Because the paperboard sheet is fairly rigid, the layer of insulating material used in the beverage holder of the invention may be relatively thin compared to the prior art beverage holders which are constructed solely from insulative foam material.

While the invention has been shown in only one of its forms, it should be apparent to those skilled in the art that it is not so limited, but is susceptible to various changes without departing from the scope of the invention.

I claim:

1. A collapsible beverage holder for a beverage container, the beverage holder comprising:

a body portion formed from a single paperboard sheet, the body portion having an upper end and a lower end and having opposite lateral side edges which are joined together to form a sleeve having an inner surface, the body portion having longitudinally extending creases which extend between the upper and lower ends and are laterally spaced apart at equal distances from each other along the body portion, the longitudinally extending creases dividing the body portion into at least six panels having substantially equal widths, the panels being foldable about the longitudinally extending creases so that the sleeve is foldable between a first configuration in which the sleeve is substantially flat and a second configuration in which the sleeve is expanded to form a single compartment having an upper opening for receiving the beverage container and a lower opening, each panel being located in a separate plane; and a single layer of polymeric foam insulation material which is bonded to the inner surface of the sleeve, the insulation material being sufficiently thin so that the beverage holder is substantially flat when the body portion is folded to the first configuration.

2. The collapsible beverage holder of claim 1, further comprising:

a substantially circular paperboard bottom portion having an upper surface, the bottom portion being joined along opposite side edges to the lower end of the body portion so that the bottom portion extends across the lower opening of the sleeve when the sleeve is in the second configuration.

3. The collapsible beverage holder of claim 2, wherein:

the bottom portion has a transverse crease which divides the bottom portion into sections, the sections being foldable about the transverse crease so that the sections fold together in a substantially flat configuration when the sleeve is in the first configuration.

4. The collapsible beverage holder of claim 1, further comprising:

a paperboard bottom portion having an upper surface, the bottom portion being joined along opposite side edges to the lower end of the body portion so that the bottom portion extends across the lower opening of the sleeve when the sleeve is in the second configuration, the bottom portion having a transverse crease which divides the bottom portion into sections, the sections being foldable about the transverse crease so that the sections fold together in a substantially flat configuration when the sleeve is in the first configuration; and a second layer of insulation material bonded to the upper surface of the bottom portion.

5. The collapsible beverage holder of claim 1, wherein:

the layer of insulation material has a thickness between 1/16 and ⅛ of an inch.

6. The collapsible beverage holder of claim 1, further comprising:

a paperboard projection located along one of the lateral side edges, the projection overlapping the other of the lateral side edges and being attached thereto so that the lateral side edges are effectively joined together.

7. A collapsible beverage holder for a beverage container, comprising in combination:

a single paperboard sheet comprising:

a rectangular body portion having an upper end and a lower end and having opposite lateral side edges which are joined together to form a sleeve having an inner surface and a lower edge, the body portion having at least five parallel, longitudinally extending creases which extend between the upper and lower ends and are laterally spaced apart along the body portion at equal distances, the longitudinally extending creases dividing the body portion into at least six substantially rigid panels having equal widths, the panels being foldable about the longitudinally extending creases so that the sleeve is foldable between a first configuration in which the sleeve is substantially flat and a second configuration in which the sleeve is expanded to form a single compartment having an upper opening for receiving the beverage container and a lower opening, each panel being located in a separate plane; and a substantially circular bottom portion extending from the lower end of the body portion, the bottom portion having a free end, the bottom portion extending across the lower opening of the sleeve when the sleeve is in the second configuration with the free end being joined to the lower edge of the sleeve, the bottom portion having an upper surface, the bottom portion having a transverse crease which divides the bottom portion into substantially rigid sections, the rigid sections being foldable about the transverse crease so that the rigid sections fold together in a substantially flat configuration when the sleeve is in the first configuration; and a single layer of polymeric foam insulation material which is bonded to the inner surface of the sleeve; and a second layer of polymeric foam insulation material bonded to the upper surface of the bottom portion.

8. The collapsible beverage holder of claim 7, wherein:

the second configuration is a polyhedron having at least six longitudinal sides of equal width.

9. The collapsible beverage holder of claim 7, wherein the paperboard sheet further comprises:

a projection extending from one of the lateral ends, the projection overlapping the other of the lateral ends of the body portion and being attached thereto so that the lateral ends are effectively joined together.

10. The collapsible beverage holder of claim 9, wherein the paperboard sheet further comprises:

a bottom tab extending from the free end of the bottom portion, the bottom tab overlapping the lower end of the body portion and being attached thereto so that the free end is effectively joined to the lower edge of the sleeve.

11. The collapsible beverage holder of claim 7, wherein: the single layer of insulation material and the second layer of insulation material each have a thickness between 1/6 and ⅛ of an inch.

* * * * *